US011467520B2

(12) United States Patent
Kitano et al.

(10) Patent No.: US 11,467,520 B2
(45) Date of Patent: Oct. 11, 2022

(54) ELECTROPHOTOGRAPHIC FIXING MEMBER, FIXING DEVICE, AND ELECTROPHOTOGRAPHIC IMAGE FORMING APPARATUS

(71) Applicant: CANON KABUSHIKI KAISHA, Tokyo (JP)

(72) Inventors: Yuji Kitano, Kanagawa (JP); Takeshi Suzuki, Kanagawa (JP); Matsutaka Maeda, Kanagawa (JP); Makoto Souma, Kanagawa (JP); Yasuhiro Miyahara, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/462,397

(22) Filed: Aug. 31, 2021

(65) Prior Publication Data

US 2022/0075296 A1 Mar. 10, 2022

(30) Foreign Application Priority Data

Sep. 8, 2020 (JP) ..... JP2020-150561
Jul. 30, 2021 (JP) ..... JP2021-125683

(51) Int. Cl.
*G03G 15/20* (2006.01)

(52) U.S. Cl.
CPC ..... *G03G 15/206* (2013.01); *G03G 15/2057* (2013.01); *G03G 15/2064* (2013.01)

(58) Field of Classification Search
None
See application file for complete search history.

(56) References Cited

U.S. PATENT DOCUMENTS

| | | | |
|---|---|---|---|
| 7,537,838 | B2 | 5/2009 | Hirabayashi et al. |
| 8,909,119 | B2 | 12/2014 | Miyahara et al. |
| 9,086,664 | B2 | 7/2015 | Matsunaka et al. |
| 9,134,663 | B2 | 9/2015 | Matsunaka et al. |
| 9,244,407 | B2 | 1/2016 | Matsumoto et al. |
| 9,268,273 | B2 | 2/2016 | Miyahara et al. |
| 9,335,690 | B2 | 5/2016 | Asaka et al. |
| 9,367,009 | B2 | 6/2016 | Akiyama et al. |

(Continued)

FOREIGN PATENT DOCUMENTS

| | | | |
|---|---|---|---|
| JP | 3-221982 | A | 9/1991 |
| JP | 7-121046 | A | 5/1995 |

(Continued)

*Primary Examiner* — Sevan A Aydin
(74) *Attorney, Agent, or Firm* — Venable LLP

(57) ABSTRACT

Provided is an electrophotographic fixing member including an elastic layer having a low hardness while maintaining a high thermal conductivity and a high strength, the elastic layer being less liable to fracture even when repeatedly compressed in a high-temperature state. The fixing member for electrophotography includes a substrate, an elastic layer on the substrate, and a surface layer in the stated order, wherein the elastic layer contains a silicone rubber and a heat conductive filler dispersed in the silicone rubber, wherein the heat conductive filler is metal oxide particles, or metal particles each having a surface at least part of which is formed of a metal oxide, and wherein the elastic layer further contains a charge control agent negatively chargeable with respect to the heat conductive filler.

9 Claims, 7 Drawing Sheets

(56) References Cited

U.S. PATENT DOCUMENTS

| | | | | |
|---|---|---|---|---|
| 10,545,439 | B2 | 1/2020 | Matsumoto et al. | |
| 10,620,574 | B2 | 4/2020 | Kitano et al. | |
| 10,712,697 | B2 | 7/2020 | Maeda et al. | |
| 10,859,956 | B2 | 12/2020 | Maeda et al. | |
| 10,890,869 | B2 | 1/2021 | Miyahara et al. | |
| 2003/0224178 | A1* | 12/2003 | Chen | G03G 15/6585 428/421 |
| 2005/0214044 | A1* | 9/2005 | Sakakibara | G03G 15/206 399/333 |
| 2019/0377291 | A1 | 12/2019 | Maeda et al. | |
| 2020/0333737 | A1 | 10/2020 | Maeda et al. | |
| 2020/0371460 | A1 | 11/2020 | Miyahara et al. | |
| 2022/0155700 | A1* | 5/2022 | Seino | G03G 9/09328 |

FOREIGN PATENT DOCUMENTS

| | | | | |
|---|---|---|---|---|
| JP | 3085727 | B2 * | 9/2000 | G03G 13/08 |
| JP | 2007-171946 | A | 7/2007 | |
| JP | 2014-044402 | A | 3/2014 | |
| JP | 2018-165807 | A | 10/2018 | |

* cited by examiner

ELECTROPHOTOGRAPHIC FIXING MEMBER, FIXING DEVICE, AND ELECTROPHOTOGRAPHIC IMAGE FORMING APPARATUS

BACKGROUND

The present disclosure relates to an electrophotographic fixing member to be used for an electrophotographic image forming apparatus, a fixing device, and an electrophotographic image forming apparatus.

DESCRIPTION OF THE RELATED ART

In general, a heat fixing device equipped in an electrophotographic image forming apparatus, such as a copying machine or a printer, comprises a pair of heated rotating bodies, such as rollers, a film and a roller, a belt and a roller, or belts, which are brought into pressure contact with each other. Such rotating bodies are called electrophotographic fixing member(s). Hereinafter, sometimes referred to as mere fixing member(s). A recording material holding an image formed with unfixed toner is introduced into a pressure contact portion, i.e., a fixing nip, formed between the rotating bodies. Then, the unfixed toner is heated together with the recording material, and the toner is pressurized against the recording material while being softened and melted, thereby being fixed onto the recording material as a fixed image. The rotating body which is brought into direct contact with the toner held on the recording material functions as a heating member, and as its form, there are known, for example, a roller shape, a film shape, and a belt shape. In addition, the rotating body that forms the fixing nip with the heating member functions as a pressurizing member, and as its form, there are known, as well as the heating member, a roller shape, a film shape, and a belt shape. Of those fixing members, the fixing member (heating member) to be brought into direct contact with the toner held on the recording material to heat the toner is required to be capable of supplying the recording material and the toner with heat for softening and melting the toner in the fixing nip. Accordingly, there is a proposal that a heat conductive filler, such as magnesium oxide or metal silicon, be incorporated into an elastic layer in the fixing member in order to improve its thermal conductivity (Japanese Patent Application Laid-Open No. H03-221982, Japanese Patent Application Laid-Open No. 2007-171946).

However, according to an investigation made by the inventors, the fixing member comprising an elastic layer which contains a heat conductive filler in order to improve the thermal conductivity has sometimes undergone a fracture of the elastic layer when used over a long period of time under high temperature. This tendency has been particularly remarkable in the case that the hardness of the elastic layer is lowered.

Accordingly, the inventors have recognized that, in order to lengthen the lifetime of the fixing member including the elastic layer having its thermal conductivity improved by incorporating the heat conductive filler thereinto, there is a need to develop a novel technology for preventing the fracture of the elastic layer due to the incorporation of the heat conductive filler.

SUMMARY

At least one aspect of the present disclosure is directed to providing an electrophotographic fixing member so excellent in durability as not to undergo the fracture of its elastic layer even when subjected to long-term use, despite including an elastic layer containing a heat conductive filler. Another aspect of the present disclosure is directed to providing a fixing device capable of stably forming high-quality electrophotographic images. Still another aspect of the present disclosure is directed to providing an electrophotographic image forming apparatus which can provide high-quality electrophotographic images.

According to one aspect of the present disclosure, there is provided an electrophotographic fixing member including: a substrate; an elastic layer on the substrate; and a surface layer, in this order, the elastic layer containing a silicone rubber and a heat conductive filler dispersed in the silicone rubber, the heat conductive filler being one of metal oxide particles or metal particles each having a surface at least part of which is formed of a metal oxide, and the elastic layer further containing a charge control agent negatively chargeable with respect to the heat conductive filler. According to another aspect of the present disclosure, there is provided a fixing device including the fixing member. According to still another aspect of the present disclosure, there is provided an electrophotographic image forming apparatus including the fixing member.

Further features of the present disclosure will become apparent from the following description of exemplary embodiments with reference to the attached drawings.

DESCRIPTION OF THE EMBODIMENTS

The inventors presume that the reason why a fixing roll according to Japanese Patent Application Laid-Open No. H03-221982 or a fixing belt according to Japanese Patent Application Laid-Open No. 2007-171946 undergoes the fracture of its elastic layer when used over a long period of time under high temperature is as described below.

Figure 1A:
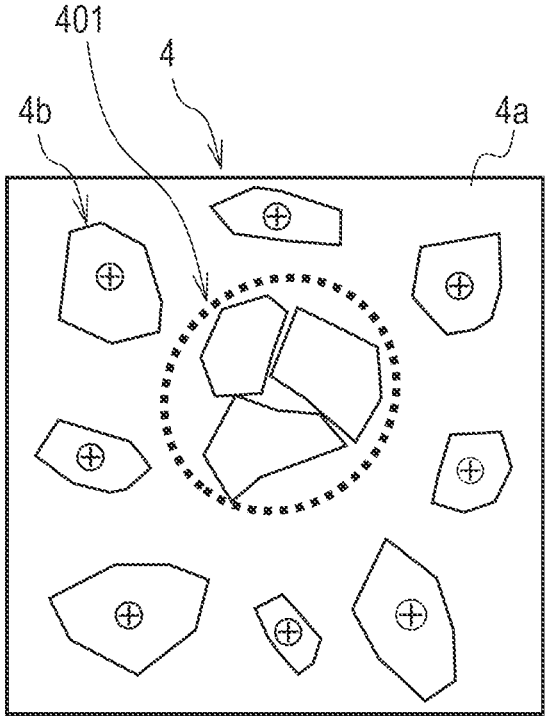
FIG. 1A and FIG. 1B are explanatory views of a presumed mechanism of the expression of an effect according to a fixing member according to one aspect of the present disclosure.

As illustrated in FIG. 1A, in an elastic layer 4, heat conductive filler(s) 4*b* are dispersed in a silicone rubber 4*a* serving as a binder, and it is conceived that an aggregated portion 401 of the heat conductive fillers 4*b* is present. The aggregated portion 401 becomes a fracture origin and a fracture of the elastic layer is initiated from the aggregated portion 401 when the elastic layer 4 is repeatedly compressed. In this case, when the degree of crosslinking of the silicone rubber 4*a* is reduced to reduce the hardness of the elastic layer 4, the silicone rubber around the aggregated portion 401 is itself reduced in strength, and hence it is conceived that the fracture of the elastic layer 4 is more liable to occur.

The inventors have made further investigations based on such speculation, and as a result, have found that an elastic layer having incorporated thereinto a silicone rubber, a heat conductive filler, and a charge control agent negatively chargeable with respect to the heat conductive filler (hereinafter sometimes referred to simply as "charge control agent") can have excellent durability.

Figure 1B:
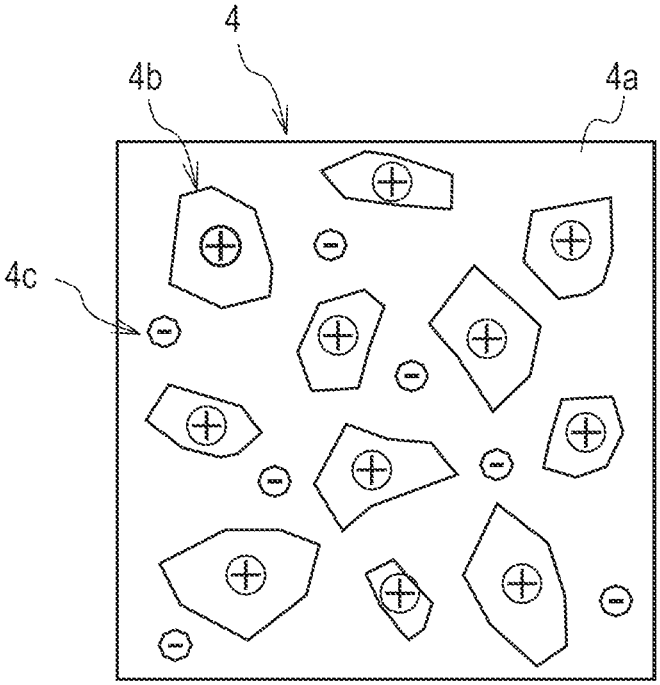

The reason why such elastic layer can have excellent durability is presumed to be as described below. That is, an elastic layer containing a silicone rubber is formed by curing an addition-curable liquid silicone rubber mixture having heat conductive fillers dispersed therein. In this addition-curable liquid silicone rubber mixture, the heat conductive fillers are positively charged by shearing with a liquid silicone rubber, but the charge amount of the respective heat conductive fillers are uneven. Accordingly, it is conceived that among the heat conductive fillers, heat conductive fillers which are almost non-charged and heat conductive fillers relatively less charged, tend to form the aggregated portion 401. Meanwhile, an elastic layer according to one aspect of the present disclosure is formed by curing an addition-curable liquid silicone rubber mixture having dispersed therein the heat conductive filler and the charge control agent. In a step of preparing the addition-curable liquid silicone rubber mixture, as illustrated in FIG. 1B, the heat conductive filler 4*b* and a charge control agent 4*c* are brought into proximity or contact with each other, and thus the heat conductive fillers 4*b* is positively charged. Further, it is conceived that, when the heat conductive fillers 4*b* are positively charged in an active manner through use of the charge control agent 4*c*, a difference hardly occurs between the charge quantities of the heat conductive fillers 4*b*. As a result, in the addition-curable liquid silicone rubber mixture, aggregation among the heat conductive fillers 4*b* is suppressed, and hence the formation of the aggregated portion 401 (see FIG. 1A) of the heat conductive fillers 4*b* is inhibited. Presumably as a result of the foregoing, the fracture energy of the elastic layer 4 is increased. The term "fracture energy" refers to the area of a stress-strain curve obtained by subjecting the elastic layer to a tensile fracture test, and as the fracture energy increases, the elastic layer becomes less liable to fracture.

This aspect is described in detail below with reference to the drawings.

(1) Fixing Member

The configuration of a fixing member for electrophotography according to the present disclosure is described with reference to the drawings.

Figure 3A:
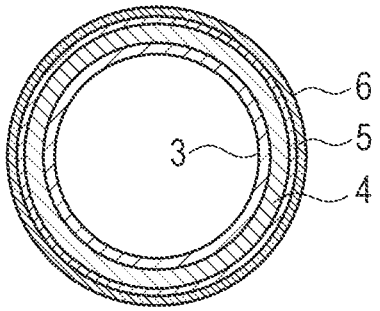
FIG. 3A and FIG. 3B are schematic sectional views of the fixing member according to the present disclosure in a belt form and a roller form, respectively.
Figure 3B:
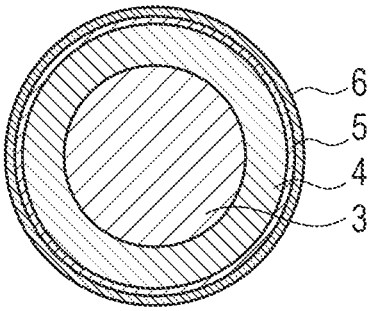

FIG. 3A and FIG. 3B are schematic sectional views for illustrating fixing members according to two aspects of the present disclosure. FIG. 3A is an illustration of a fixing member having an endless belt shape (hereinafter sometimes referred to as "fixing belt"), and FIG. 3B is an illustration of a fixing member having a roller shape. Hereinafter sometimes referred to as "fixing roller". The fixing rollers according to FIG. 3A and FIG. 3B each include a substrate 3, the elastic layer 4 containing a silicone rubber covering the outer peripheral surface of the substrate 3, and a surface layer 6 covering the outer peripheral surface of the elastic layer 4. An adhesion layer 5 between the elastic layer 4 and the surface layer 6 is an option, and for example, in such a case that the surface layer 6 is a product formed by melting fluorine resin particles that have been caused to adhere to the outer peripheral surface of the elastic layer 4, a configuration free of the adhesion layer 5 may be adopted.

(2) Substrate

When the fixing member is such fixing belt as illustrated in FIG. 3A, a metal, such as an electroformed nickel sleeve or a stainless-steel sleeve, or a heat-resistant resin, such as polyimide, may be used for the substrate. On the outer surface (surface on the elastic layer side) of the substrate, a layer for imparting a function of improving an adhesive property with the elastic layer may be arranged. That is, the elastic layer only needs to be arranged over the outer peripheral surface of the substrate, and another layer may be arranged between the elastic layer and the substrate. In addition, on the inner surface (surface on the opposite side to the outer surface) of the substrate, a layer for imparting a function, such as wear resistance or lubricity, may be further arranged.

When the fixing member is such fixing roller as illustrated in FIG. 3B, the substrate only needs to have a strength enough to withstand heating and pressurization in a fixing device, and for example, a mandrel formed of a metal, such as aluminum or iron, or an alloy may be used. A solid mandrel is used as the substrate in FIG. 3B. However, a hollow mandrel may be used as the substrate, and a heat source, such as a halogen lamp, may be arranged therein.

(3) Elastic Layer

The fixing member according to the present disclosure may be used as any one of a heating member and a pressurizing member in a fixing device. Further, when the fixing member is used as the heating member, the elastic layer functions as a layer for allowing the outer surface of the heating member to follow the irregularities of paper at the time of fixation. In addition, when the fixing member is used as the pressurizing member, the elastic layer functions as a layer for sufficiently securing the width of a fixing nip to be formed with the pressurizing member. In order to express those functions in an environment having a temperature as high as 240° C. in a non-paper passing portion region, the elastic layer contains as a binder a silicone rubber excellent in heat resistance. That is, the elastic layer contains a silicone rubber and a heat conductive filler dispersed in the silicone rubber.

Further, the elastic layer may be formed by, for example, curing an addition-curable liquid silicone rubber mixture containing the heat conductive filler and an addition-curable liquid silicone rubber. That is, the elastic layer may be a cured product of the addition-curable liquid silicone rubber mixture. In addition, the elastic layer may be a layer containing a cured product of the addition-curable liquid silicone rubber, and a heat conductive filler and a charge control agent negatively chargeable with respect to the heat conductive filler, which are present in the cured product.

The elastic layer has an Asker C hardness based on Japanese Industrial Standard (JIS) K7312:1996 (hereinafter sometimes referred to simply as "hardness") of preferably 50° or less. When the hardness is 50° or less, the elastic layer does not undergo destructive/plastic deformation even when repeatedly compressed in a high-temperature state, and has excellent flexibility.

The hardness of the elastic layer may be adjusted based on, for example, the kinds and blending amounts of a component (a), a component (b), and a component (c) in the addition-curable liquid silicone rubber, which are described later.

The silicone rubber, the heat conductive filler, and the charge control agent serving as constituent components of the elastic layer are described in detail below.

(3-1) Silicone Rubber

The addition-curable liquid silicone rubber contains at least the following component (a), component (b), and component (c), and contains the following component (d) as required:

(a) an organopolysiloxane having an unsaturated aliphatic group in the molecule;

(b) an organopolysiloxane having active hydrogen bonded to a silicon atom;

(c) a hydrosilylation catalyst; and (d) a curing retarder.

Component (a): Organopolysiloxane Having Unsaturated Aliphatic Group in Molecule An example of the organopolysiloxane having an unsaturated aliphatic group in the molecule is an organopolysiloxane containing, in one molecule thereof, at least two unsaturated aliphatic groups, such as vinyl groups, each of which is bonded to a silicon atom. Specific examples thereof include organopolysiloxanes according to the following items (i) and (ii).

(i) A linear organopolysiloxane having at least one intermediate unit selected from the group consisting of an intermediate unit represented by $R_1R_1S_iO$ and an intermediate unit represented by $R_1R_2S_iO$, and molecular ends each represented by $R_1R_1R_2S_iO_{1/2}$ (see the following structural formula 1)

Structural Formula 1

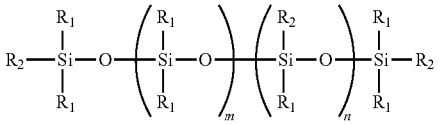

(ii) A linear organopolysiloxane having at least one intermediate unit selected from the group consisting of an intermediate unit represented by $R_1R_1S_iO$ and an intermediate unit represented by $R_1R_2S_iO$, and molecular ends each represented by $R_1R_1R_1S_iO_{1/2}$ (see the following structural formula 2)

Structural Formula 2

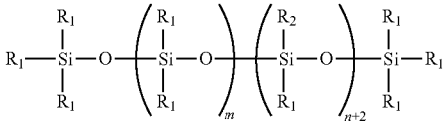

In the structural formula 1 and the structural formula 2, $R_1$s each independently represent an unsubstituted hydrocarbon group free of any unsaturated aliphatic group, $R_2$s each independently represent an unsaturated aliphatic group, and "m" and "n" each independently represent an integer of 0 or more.

Examples of the unsubstituted hydrocarbon group free of any unsaturated aliphatic group represented by each of $R_1$s in the structural formula 1 and the structural formula 2 may include alkyl groups, such as a methyl group, an ethyl group, and a propyl group, and aryl groups, such as a phenyl group. Of those, $R_1$s each preferably represent a methyl group. In addition, examples of the unsaturated aliphatic group represented by each of $R_2$s in the structural formulae 1 and 2 may include alkenyl groups, such as a vinyl group, an allyl group, and a 3-butenyl group. Of those, $R_2$s each preferably represent a vinyl group.

In the structural formula 1, the linear organopolysiloxane in which n=0 has unsaturated aliphatic groups only at both ends thereof, and the linear organopolysiloxane in which n=1 or more has unsaturated aliphatic groups at both ends thereof and in a side chain thereof. In addition, the linear organopolysiloxane of the structural formula 2 has unsaturated aliphatic groups only in side chains thereof. The components (A) may be used alone or in combination thereof.

In addition, when the component (A) is used for the elastic layer of the fixing member, its viscosity is preferably 100 $mm^2/s$ or more and 50,000 $mm^2/s$ or less from the viewpoint of moldability.

(b) Organopolysiloxane Having Active Hydrogen Bonded to Silicon Atom

The organopolysiloxane having active hydrogen bonded to a silicon atom, which serves as a crosslinking agent for the component (a), is a crosslinking agent for forming a crosslinked structure through a hydrosilylation reaction with the unsaturated aliphatic group in the component (a) via the catalytic action of the component (c) to be described later.

Any organopolysiloxane having a Si—H bond may be used as the component (b), and examples thereof include the following organopolysiloxanes (iii) and (iv). The components (b) may be used alone or in combination thereof.

(iii) An organopolysiloxane in which the average number of hydrogen atoms each bonded to a silicon atom is 3 or more per molecule from the viewpoint of forming a crosslinked structure through a reaction with the organopolysiloxane having an unsaturated aliphatic group.

(iv) An organopolysiloxane in which an organic group bonded to a silicon atom is such an unsubstituted hydrocarbon group free of any unsaturated aliphatic group as described above. The unsubstituted hydrocarbon group is preferably a methyl group.

In the organopolysiloxane serving as the component (b), the siloxane backbone (—Si—O—Si—) may be any one of linear, branched, and cyclic ones. In addition, the Si—H bond may be present in any siloxane unit in the molecule. Further, specifically, linear organopolysiloxanes represented by the following structural formula 3 and structural formula 4 may each be used as the component (b).

Structural Formula 3

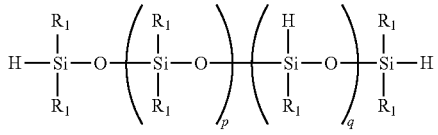

Structural Formula 4

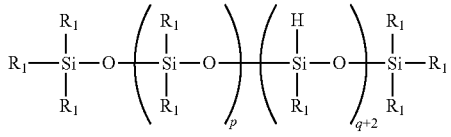

In the structural formula 3 and the structural formula 4, $R_1$s each independently represent an unsubstituted hydrocarbon group free of any unsaturated aliphatic group, "p" represents an integer of 0 or more, and "q" represents an integer of 1 or more. Examples of the unsubstituted hydrocarbon group free of any unsaturated aliphatic group may include the same ones as those given for $R_1$s in the structural formulae 1 and 2. Of those, a methyl group is preferred.

The blending amount of the component (b) is preferably from 0.1 part by mass to 20 parts by mass, more preferably from 0.3 part by mass to 10 parts by mass with respect to 100 parts by mass of the component (a).

(c) Hydrosilylation Catalyst

For example, a platinum compound may be used as the hydrosilylation (addition curing) catalyst. Specific examples thereof may include a platinum carbonyl cyclovinylmethylsiloxane complex and a 1,3-divinyltetramethyldisiloxane platinum complex. The blending amount of the component (c) is preferably from 0.0001 part by mass to 0.1 part by mass, more preferably from 0.001 part by mass to 0.05 part by mass with respect to 100 parts by mass of the component (a).

(d) Curing Retarder

The curing retarder may be blended in order to adjust the curing reaction rate of hydrosilylation (addition curing). Specific examples of the curing retarder may include 1,3,5,7-tetravinyltetramethylcyclotetrasiloxane, 2-methyl-3-butyn-2-ol, and 1-ethynyl-1-cyclohexanol. The blending amount of the component (d) is preferably from 0.01 part by mass to 2 parts by mass, more preferably from 0.05 part by mass to 1 part by mass with respect to 100 parts by mass of the component (a).

(3-2) Heat Conductive Filler

The heat conductive filler is, for example, at least one kind selected from the group consisting of: metal oxide particles; and metal particles each having a surface at least part of which is formed of a metal oxide.

Examples of such heat conductive filler include magnesium oxide, metal silicon, alumina, and zinc oxide.

The thermal conductivity of magnesium oxide is from 45 W/m·K to 60 W/m·K, the thermal conductivity of metal silicon is 150 W/m·K, the thermal conductivity of zinc oxide is 50 W/m·K, and the thermal conductivity of alumina is 40 W/m·K.

The thermal conductivity of a silicone rubber having no filler blended thereinto is about 0.2 W/m·K, and hence the incorporation of any of those heat conductive fillers into the silicone rubber can improve the thermal conductivity of the elastic layer.

With regard to the content of the heat conductive filler in the elastic layer, the total amount of the filler is preferably 10% or more and 55% or less in terms of volume ratio. When the total amount of the filler is 10% or more in terms of volume ratio, the thermal conductivity of the elastic layer formed of the silicone rubber can be sufficiently improved, and when the total amount of the filler is 55% or less in terms of volume ratio, the elastic layer formed of the silicone rubber can sufficiently exhibit an elastic function as a rubber.

(3-3) Charge Control Agent

The above-mentioned metal oxide particles, and metal particles each having a surface at least part of which is formed of a metal oxide, which serve as the heat conductive filler, may each have positive chargeability. The order of decreasing ease of being charged with a positive charge is presumably as follows: magnesium oxide, metal silicon at least part of whose surface is oxidized, zinc oxide, and alumina.

Further, examples of the negatively chargeable charge control agent capable of imparting a positive charge to such heat conductive filler include a salicylic acid-metal complex and an azo metal complex.

Of those, an azo metal complex is more preferred from the viewpoint of heat resistance. Examples of the azo metal complex may include iron-based and chromium-based complexes. With regard to the heat resistance, the non-paper passing portion of the fixing member sometimes reaches about 240° C., and hence it is desired that the heat resistance provide stability in the range of temperatures equal to or higher than about 240° C., and it is particularly desired that the thermal decomposition onset temperature of the charge control agent be 300° C. or more. Specific examples of the charge control agent having such heat resistance may include compounds represented by the following structural formula (i) and structural formula (ii).

Structural Formula (i)

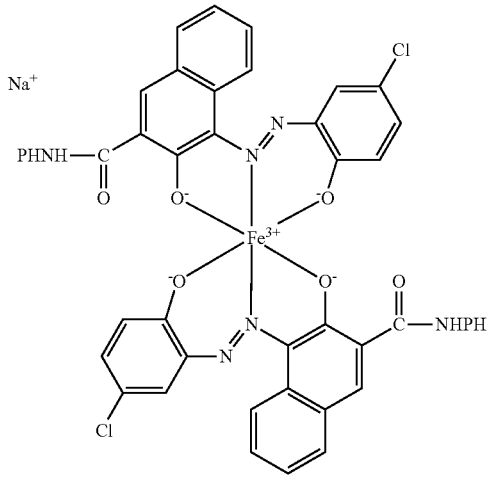

Structural Formula (ii)

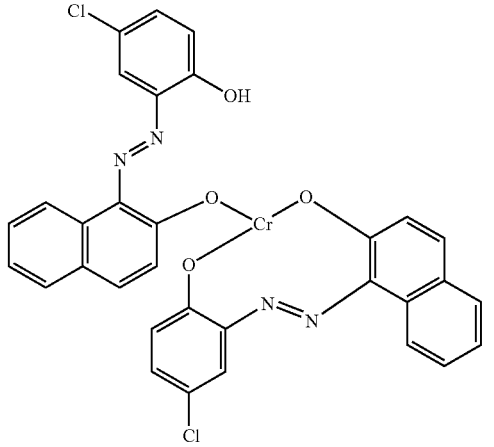

The compound according to the structural formula (i) is commercially available, for example, under the product name "S-215S" (manufactured by Orient Chemical Industries Co., Ltd.), and the compound according to the structural formula (ii) is commercially available, for example, under the product name "S-34" (manufactured by Orient Chemical Industries Co., Ltd.). Other candidates for the negatively chargeable charge control agent may include agents mainly used in toner.

The blending amount of the charge control agent is more preferably 1 part by mass or more and 5 parts by mass or less with respect to 100 parts by mass of the silicone rubber. When the blending amount is 1 part by mass or more, a fracture energy-increasing effect is obtained. In addition, when the blending amount is 5 parts by mass or less, a sufficient hardness is obtained in the non-paper passing portion of the silicone rubber elastic layer.

In addition, the dispersed state of the charge control agent is not particularly limited, but the charge control agent is more preferably dispersed in the silicone rubber as particles each having a diameter of 1 μm or less because the fracture energy-increasing effect may be easily obtained.

(3-4) Method of Producing Elastic Layer

As a non-limiting method of producing the elastic layer according to one aspect of the present disclosure, for example, the elastic layer may be formed through a step of curing a layer of the addition-curable liquid silicone rubber mixture (hereinafter sometimes referred to as "mixture layer"). In this case, prior to the curing of the mixture layer, the outer surface of the mixture layer is preferably charged. With this procedure, the heat conductive fillers in the mixture layer can be arrayed in its thickness direction, and hence the thermal conductivity of the elastic layer in its thickness direction can be further improved.

A method involving using a corona charger is described as one embodiment in which the heat conductive fillers in the mixture layer are arrayed in its thickness direction. Corona charging systems are classified into a scorotron system in which a grid electrode is present between a corona wire and a body to be charged, and a corotron system in which no grid electrode is present. Of those, a scorotron system is preferred from the viewpoint of the controllability of the surface potential of the body to be charged.

Figure 2A:
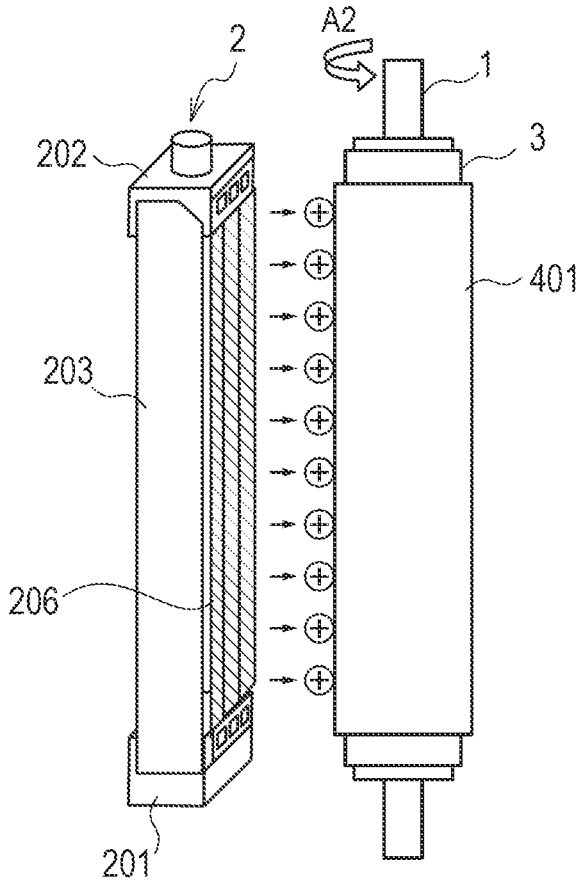
FIG. 2A is a bird's-eye view of a corona charger for forming an elastic layer of the fixing member according to one aspect of the present disclosure.
Figure 2B:
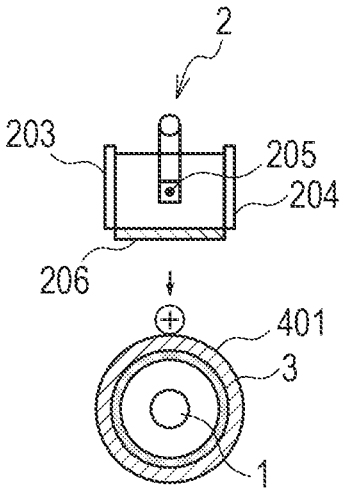
FIG. 2B is a sectional view of the corona charger for forming the elastic layer of the fixing member according to one aspect of the present disclosure.

As illustrated in FIG. 2A and FIG. 2B, a corona charger 2 includes blocks 201 and 202, shields 203 and 204, and grids 206. In addition, a discharge wire 205 is tensioned between the block 201 and the block 202. A high voltage is applied to the discharge wire 205 by a high-voltage power supply (not shown), and an ion current obtained by discharge to the shields 203 and 204 is controlled by applying a high voltage to the grids 206. Thus, the surface of the mixture layer 401 is charged. At this time, the substrate 3 or a core 1 for holding the substrate 3 is grounded (not shown), and hence a desired electric field can be generated in the mixture layer 401 by controlling the surface potential of the surface of the mixture layer 401.

As illustrated in FIG. 2A, the corona charger 2 is arranged near the mixture layer 401 to face the layer along the width direction of the layer. Then, under a state in which a voltage is applied to the grids 206 of the corona charger 2 to cause the grids to discharge, the core 1 is rotated in a direction indicated by an arrow A2 to rotate the substrate 3 having the mixture layer 401 on its outer peripheral surface at, for example, 100 rpm for 20 seconds. Thus, the outer surface of the mixture layer 401 is charged. A distance between the outer surface of the mixture layer 401 and the grids 206 may be set to from 1 mm to 10 mm.

Figure 7:
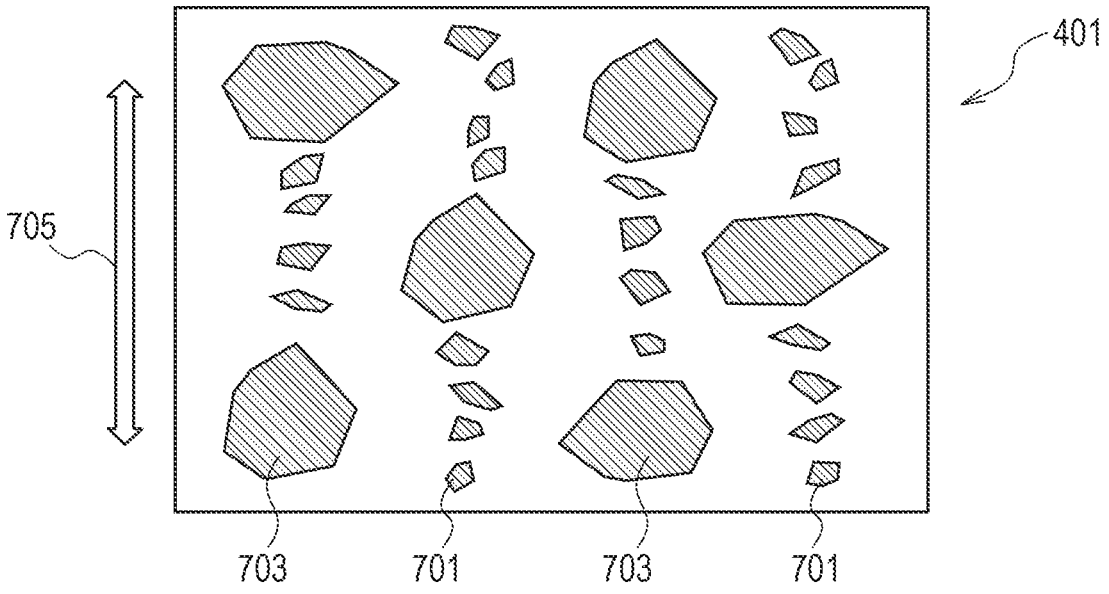
FIG. 7 is an explanatory view of the arrayed state of a heat conductive filler formed in a mixture layer having a charged surface.

The surface of the mixture layer 401 is charged as described above to generate an electric field in the mixture layer 401. As a result, as illustrated in FIG. 7, of the heat conductive fillers in the mixture layer 401, for example, small-particle diameter fillers 701 each having a circle-equivalent diameter of less than 5 μm can be arrayed in the thickness direction of the mixture layer 401. Meanwhile, of the heat conductive fillers, for example, large-particle diameter fillers 703 each having a circle-equivalent diameter of 5 μm or more remain substantially unchanged in terms of their positions in the mixture layer 401, and the large-particle diameter fillers are polarized to generate a local electric field between themselves. By virtue of such electric field, the small-particle diameter fillers positioned between the large-particle diameter fillers can be arrayed. In FIG. 7, an arrow 705 indicates the thickness direction of the mixture layer. Now, the reason why, when the surface of the mixture layer 401 is charged, the small-particle diameter fillers can be arrayed to a high degree while the array of the large-particle diameter fillers is suppressed is conceivably as described below. That is, it is conceived that, even when the surface of the mixture layer 401 is charged, it is difficult to cause a force to act on the large-particle diameter fillers 703, the force being enough to move the positions of the large-particle diameter fillers 703 in the mixture layer through dielectrophoresis. However, dielectric polarization occurs in the large-particle diameter fillers 703, and hence a local electric field is formed between the large-particle diameter fillers 703. As a result, the small-particle diameter fillers 701 present between the large-particle diameter fillers 703 are conceivably subjected to the local electric field to be arrayed to a high degree between the large-particle diameter fillers 703. As a result, a heat conductive path in which the large-particle diameter fillers 703 are connected to each other via the small-particle diameter fillers is conceivably formed in the thickness direction of the mixture layer.

The absolute value of the voltage to be applied to the grids 206 preferably falls within the range of from 0.3 kV to 3 kV from the viewpoint that an effective electrostatic interaction is caused to occur between the heat conductive fillers, and the absolute value particularly preferably falls within the range of from 0.6 kV to 2 kV. In FIG. 2A and FIG. 2B, an example in which the surface of the mixture layer 401 is positively charged is illustrated. However, when the sign of the voltage to be applied is set to be equal to the sign of the voltage to be applied to the wire, the same effect is obtained irrespective of whether the sign is negative or positive, though the direction of an electric field in the case of a negative sign is opposite to that in the case of a positive sign.

The ease with which the small-particle diameter fillers in the mixture layer 401 are arrayed may depend on, for example, the dielectric constants of binder raw materials and the heat conductive fillers. For example, when the dielectric constants of the binder raw materials largely differ from the dielectric constants of the heat conductive fillers, the small-particle diameter fillers may be arrayed by a relatively small applied voltage. Accordingly, it is preferred that the voltage to be applied to the grids be appropriately adjusted in accordance with the combination of materials to be used as the binder raw materials and the kinds of the heat conductive fillers.

The range of potential control in the longitudinal direction of the surface of the mixture layer 401 is preferably a range above the paper passing region of the fixing member. For example, a construction illustrated in FIG. 2A may be used, and when the voltage is applied to the grids 206 while the fixing belt is rotated by using the central axis of the substrate having the mixture layer 401 as a rotation axis during the application, the entirety of the mixture layer 401 may be charged. The number of revolutions of the fixing belt is preferably set to from 10 rpm to 500 rpm, and a treatment time of 5 seconds or more is preferably provided as a treatment time for the charging from the viewpoint that the array of the small-particle diameter fillers is stably formed. As can be seen from the foregoing, the formation of the array of the small-particle diameter fillers can be controlled by controlling the surface potential of the layer and the time period for which an electric field is applied to the layer.

A material such as stainless steel, nickel, molybdenum, or tungsten may be appropriately used as the discharge wire 205. Of those, tungsten having extremely high stability among metals is preferably used. The shape of the discharge wire 205 to be tensioned inside the shields 203 and 204 is not particularly limited, and for example, a discharge wire having a shape like a saw tooth or such a discharge wire that a sectional shape when the wire is vertically cut is a circular shape (circular sectional shape) may be used. The diameter of the discharge wire 205 (in a cut surface when the wire is vertically cut) is preferably set to 40 μm or more and 100 μm or less. When the diameter of the discharge wire 205 is 40 μm or more, the breakage and tear of the discharge wire due to the collision of an ion caused by the discharge can be easily prevented. In addition, when the diameter of the discharge wire 205 is 100 μm or less, a moderate applied voltage can be applied to the discharge wire 205 at the time of the obtainment of stable corona discharge, and hence the occurrence of ozone can be easily prevented.

As illustrated in FIG. 2B, the flat plate-shaped grids 206 may be arranged between the discharge wire 205 and the mixture layer 401 arranged on the substrate 3. Herein, from the viewpoint that the charged potential of the surface of the mixture layer 401 is uniformized, the distance between the surface of the mixture layer 401 and the grids 206 is preferably set within the range of from 1 mm or more to 10 mm or less.

Incidentally, when the mixture layer 401 contained no charge control agent, the above-mentioned charging step sometimes resulted in the formation of a protrusive seeding defect on the outer surface of the mixture layer 401. This is conceivably because, when the outer surface of the mixture layer 401 was charged, unevenness in surface potential occurred, and the protrusive seeding defect was formed in a portion where the surface potential was locally low. Conceivable causes of the occurrence of the unevenness in surface potential are shearing unevenness in the step of preparing the addition-curable liquid silicone rubber mixture, and a variation in surface composition of the heat conductive filler. It is presumed that the shearing unevenness and the variation in surface composition of the heat conductive filler generate a portion where the charge quantity of the heat conductive filler is locally high, resulting in a low surface potential in the portion.

However, when the addition-curable liquid silicone rubber mixture according to this aspect containing the charge control agent is used, the occurrence of the protrusive seeding defect on the outer surface can be prevented. This is conceivably because the charge control agent can uniformize the charge quantity of the heat conductive filler, and hence the portion where the charge quantity is locally high is hardly generated.

(4) Surface Layer of Fixing Member

As the surface layer, there may be used, for example, a fluorine resin layer, more specifically, a layer of any one of resins listed as examples below. Examples of the fluorine resin may include a tetrafluoroethylene-perfluoro(alkyl vinyl ether) copolymer (PFA), polytetrafluoroethylene (PTFE), and a tetrafluoroethylene-hexafluoropropylene copolymer (FEP).

In addition, a filler may be incorporated into the surface layer for the purpose of improving thermophysical properties and wear resistance to the extent that moldability and a toner release property are not impaired.

The thickness of the surface layer (e.g., the fluorine resin layer) is preferably set to 10 μm or more and 100 μm or less. When the thickness of the surface layer is 10 μm or more, sufficient durability is obtained. When the thickness of the surface layer is 100 μm or less, the excellent flexibility of the silicone rubber-containing elastic layer can function.

A method of forming the surface layer is not particularly limited, and for example, the following method 1) or 2) may be used.

1) Method of Forming Surface Layer Through Covering with Fluorine Resin Tube

Figure 4:
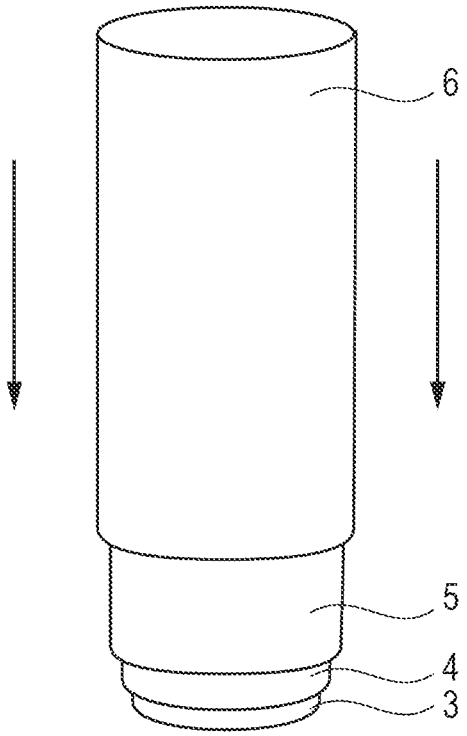
FIG. 4 is a schematic view of an example for describing a step of laminating a fluorine resin surface layer.

FIG. 4 is a schematic view for describing the method 1). An adhesive is applied to the surface of the elastic layer 4 formed of the silicone rubber to form the adhesion layer 5. The adhesive is described later. The outer surface of the adhesion layer 5 is covered with a product obtained by molding a fluorine resin into a tube shape, so that the product may serve as the surface layer 6 laminated on the outer surface. When the inner surface of the fluorine resin tube is subjected to sodium treatment, excimer laser treatment, ammonia treatment, or the like in advance, the surface can be activated to be improved in adhesive property.

An addition-curable silicone rubber blended with a self-adhesive component is preferably used as the adhesive. As the silicone rubber, specifically, a silicone rubber containing an organopolysiloxane having a plurality of unsaturated aliphatic groups typified by a vinyl group in its molecular chain, a hydrogen organopolysiloxane, and a platinum compound serving as a crosslinking reaction catalyst may be used. This silicone rubber is cured through an addition reaction. A known adhesive may be used as the adhesive formed of such addition-curable silicone rubber.

Although not required when the substrate 3 is a mandrel capable of holding its shape, it is preferred that, when a thin substrate, such as a resin belt or a metal sleeve, to be used for a fixing member of a belt shape is used, the substrate 3 be held by being externally fitted onto a core in order to prevent deformation at the time of processing. Although a method for the covering with the fluorine resin tube is not particularly limited, for example, a method involving covering the outer surface through use of the adhesive as a lubricant, or a method involving expanding the fluorine resin tube from its outside to cover the outer surface may be used. After the covering, the redundant adhesive remaining between the elastic layer 4 formed of the silicone rubber and the fluorine resin tube 6 may be removed by being squeezed out with a unit (not shown). The thickness of the adhesion layer 5 after the squeezing is preferably 20 μm or less. When the thickness of the adhesion layer is 20 μm or less, an increase in hardness of the fixing member can be easily suppressed, and in the case of use as the fixing member, its property of following the irregularities of paper is excellent. Next, the adhesion layer is cured through heating with a heating unit, such as an electric furnace, for a predetermined period of time, and as required, both end portions of the resultant are processed into a desired length. Thus, the fixing member according to this aspect may be obtained.

2) With regard to Formation of Surface Layer by Fluorine Resin Coating

For fluorine resin coating processing for forming the surface layer, a method such as an electrostatic coating method with fluorine resin fine particles or spray coating with a fluorine resin paint may be used. In the case of using the electrostatic coating method, first, the inner surface of a mold is electrostatically coated with fluorine resin fine particles, and the mold is heated to a temperature equal to or higher than the melting point of the fluorine resin, to thereby form a thin film of the fluorine resin on the inner surface of the mold. After that, the inner surface is subjected to adhesion treatment, and then the substrate is inserted. The addition-curable liquid silicone rubber mixture according to this aspect containing at least the heat conductive filler, the negatively chargeable charge control agent, and for example, an addition-curable liquid silicone rubber component is injected between the substrate and the fluorine resin. After that, the rubber mixture is cured, followed by demolding. Thus, the fixing member according to this aspect may be obtained.

(5) Method of Producing Fixing Member

A method of producing the fixing member according to this aspect includes, for example, the following steps of forming an elastic layer containing a silicone rubber:

preparing a liquid silicone mixture containing a liquid silicone polymer and a heat conductive filler and a charge control agent negatively chargeable with respect to the heat conductive filler, which are dispersed in the liquid silicone polymer;

forming a layer of the liquid silicone mixture on the surface of a substrate having an endless shape;

arranging a corona charger along the width direction of the substrate to face the surface of the layer of the liquid silicone mixture;

charging the surface of the layer of the liquid silicone mixture through use of the corona charger; and curing the layer of the liquid silicone mixture to obtain the elastic layer.

In addition, the method of producing the fixing member according to this aspect may include the following step:

laminating an adhesion layer and a surface layer (e.g., a fluorine resin surface layer) on the elastic layer containing the silicone rubber.

In the method of producing the fixing member according to this aspect, the order of the steps may be appropriately set, and those steps may also be performed simultaneously (in parallel). When the surface layer is formed, the above-mentioned methods of forming the adhesion layer and the surface layer may be used.

(6) Fixing Device in which Fixing Member of the Present Disclosure is Arranged

A fixing device according to one aspect is described. The fixing device according to this aspect is a fixing device to be used for an electrophotographic image forming apparatus, and includes the fixing member according to the above-mentioned aspect arranged as a fixing belt, a fixing roller, or a fixing film. An example of the electrophotographic image forming apparatus is an electrophotographic image forming apparatus including, for example, a photosensitive member, a unit configured to form a latent image, a unit configured to develop the formed latent image with toner, a unit configured to transfer the developed toner image onto a recording material, and a unit configured to fix the toner image on the recording material.

Figure 5:
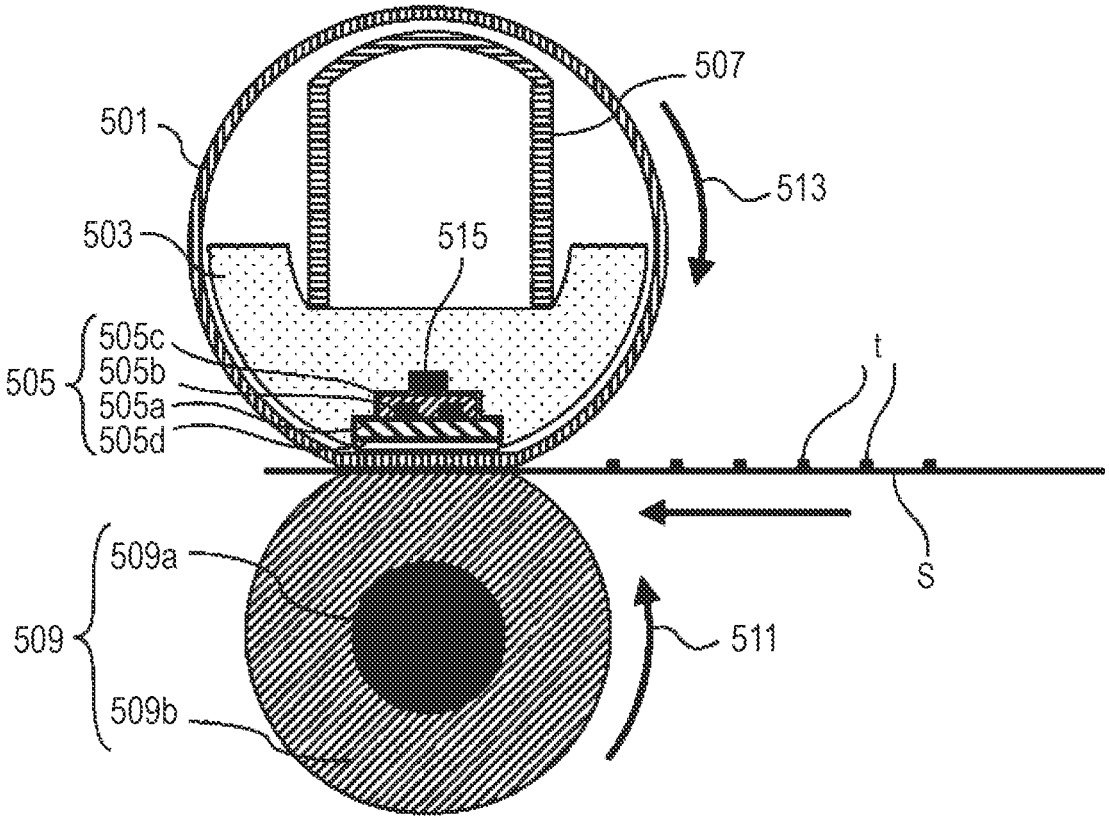
FIG. 5 is a schematic sectional view of an example of a fixing device in which the fixing member of the present disclosure is arranged.

A schematic configuration view of a fixing device according to one embodiment of this aspect is illustrated in FIG. 5.

FIG. 5 is a schematic view for illustrating an example of a heat fixing device of a fixing belt-pressurizing roller system using a ceramic heater as a heating body. In FIG. 5, a fixing belt 501 is according to one aspect of the present disclosure. The fixing belt 501 is externally fitted onto a belt guide 503 in a loose manner. In addition, a rigid stay 507 for pressurization is inserted into the belt guide 503. A pressurizing roller 509 is arranged below the fixing belt 501 to face the fixing belt 501. The pressurizing roller 509 includes a mandrel 509*a*, and an elastic layer 509*b* arranged on the outer peripheral surface of the mandrel 509*a* and containing a silicone rubber. In the pressurizing roller 509, both end portions of the mandrel 509*a* are rotatably held with bearings between a chassis side plate on a front side and a chassis side plate on a rear side (not shown). The pressurizing roller 509 may be provided with a surface layer (not shown) containing a fluorine resin, such as a tetrafluoroethylene-perfluoroalkyl ether copolymer (PFA) in order to improve the toner release property of its surface.

A pressurizing spring (not shown) is arranged between each of both end portions of the rigid stay 507 for pressurization and a spring-receiving member (not shown) on the chassis side of the fixing device to apply a depression force to the rigid stay 507 for pressurization. Thus, the lower surface of a ceramic heater 505 arranged on the lower surface of the belt guide 503 and the upper surface of the pressurizing roller 509 form a fixing nip portion N with the fixing belt 501 sandwiched therebetween.

The pressurizing roller 509 is rotationally driven in a direction indicated by an arrow 511 by a driving unit (not shown). A frictional force between the pressurizing roller 509 and the outer surface of the fixing belt 501 caused by the rotational driving of the pressurizing roller 509 applies a rotational force to the fixing belt 501. Then, the fixing belt 501 rotates outside the belt guide 503 in a direction indicated by an arrow 513 at a speed corresponding to the rotational speed of the pressurizing roller 509 while its inner surface slides under a state of being in close contact with the lower surface of the ceramic heater 505 in the fixing nip portion N.

The rotation of the pressurizing roller 509 is started and the heating of the ceramic heater 505 is started based on a print start signal. After that, a recording medium S bearing unfixed toner images "t", which serves as a material to be heated, is introduced between the fixing belt 501 and the pressurizing roller 509 in the fixing nip portion N with its toner image-bearing surface side directed toward the fixing belt 501. Then, the recording medium S is in close contact with the lower surface of the ceramic heater 505 in the fixing nip portion N via the fixing belt 501, and moves through the fixing nip portion N together with the fixing belt 501. In the process, the heat of the fixing belt 501 is applied to the recording medium S to fix the toner images "t" onto the surface of the recording medium S. The recording medium S that has passed through the fixing nip portion N is separated from the outer surface of the fixing belt 501 and conveyed.

The ceramic heater 505 serving as a heating body includes, for example, a heater substrate 505*a* made of aluminum nitride, heat-generating layers 505*b* arranged on the surface of the heater substrate 505*a* along its longitudinal direction, and a protective layer 505*c* arranged over the heat-generating layers 505*b* and formed of a material excellent in heat resistance, such as glass or a fluorine resin. The heat-generating layers 505*b* to be used may each be arranged by, for example, subjecting an electrical resistance material, such as a silver-palladium (Ag—Pd) alloy, to screen printing or the like so as to have a thickness of 10 μm and a width of from 1 mm to 5 mm. Further, when an electric current is flowed between both ends of each of the heat-generating layers 505*b* of the ceramic heater 505, the heat-generating layers 505*b* generate heat to increase the temperature of the ceramic heater 505. The ceramic heater 505 is fixed by being fitted into the groove portion formed in substantially the central portion of the lower surface of the belt guide 503 along the longitudinal direction of the guide with the protective layer 505*c* directed upward. In the fixing nip portion N in contact with the fixing belt 501, the surface of a sliding member 505*d* of the ceramic heater 505 and the inner peripheral surface of the fixing belt 501 are brought into contact with each other to slide. On the protective layer 505*c*, there is arranged a temperature detector element 515 for the control of the temperature of the ceramic heater 505.

As described above, in the above-mentioned heat fixing device, which uses the fixing belt 501 according to the present disclosure as a heating belt, heat supplied to the fixing belt by the heating unit (heater) arranged to be brought into contact with the inner peripheral surface of the fixing belt 501 flows easily in the thickness direction of the elastic layer. Accordingly, energy input into the fixing belt can be efficiently utilized for the heat fixation of unfixed toner.

The fixing device including the fixing belt and the pressurizing roller has been given as an example herein. However, the fixing device according to this aspect only needs to include the fixing member according to this aspect as a fixing belt, a fixing roller, or a fixing film, and is not limited to the one illustrated in FIG. 5.

According to one aspect of the present disclosure, the fixing member for electrophotography so excellent in durability as not to undergo the fracture or plastic deformation of its elastic layer even when subjected to long-term use, despite including the elastic layer containing the heat conductive filler, can be provided. According to other aspects of the present disclosure, the fixing device and the electrophotographic image forming apparatus that are capable of stably forming high-quality electrophotographic images can be provided.

EXAMPLES

The present disclosure is described in more detail below by way of Examples.

First, a method of judging whether a charge control agent is of a negative charging type or a positive charging type with respect to a heat conductive filler is described. A solution having dissolved therein the charge control agent is subjected to spin coating to form a film formed of the charge control agent. The heat conductive filler is placed on the film, and the charge control agent and the heat conductive filler are rubbed against each other by, for example, moving the film. The surface potential of the film in this case is measured, and based on the result indicating whether the film is negatively charged or positively charged, it may be judged whether the charge control agent is of the negative charging type or the positive charging type.

Next, a method of measuring the thermal decomposition onset temperature of a charge control agent is described. Through use of a thermogravimetric analyzer (TGA/SDTA851e, manufactured by Mettler Toledo), a temperature is increased from 40° C. to 400° C. at 3° C./min. The onset temperature of a sample weight curve (point of intersection between a tangent line at a point of inflection of the curve and an extended line of the base line) during the temperature increase was adopted as the thermal decomposition onset temperature.

Next, a method of evaluating the dispersed state of a charge control agent is described. First, a section of an elastic layer is subjected to polishing processing with an ion beam. For example, a cross section polisher may be used for the polishing processing of the section with the ion beam. In the polishing processing of the section with the ion beam, the falling of a filler from the sample and the inclusion of a polishing agent can be prevented, and a section having a small number of polishing marks can be formed. The thus formed section of the elastic layer was subjected to the sputter cleaning of the sample surface, and then evaluated by measuring the distribution of ions presumably derived from the charge control agent through use of time-of-flight secondary ion mass spectrometry (TOF-SIMS).

Example 1

(1) Preparation of Addition-Curable Liquid Silicone Rubber Mixture

First, 100 parts by mass of a silicone polymer having vinyl groups serving as unsaturated aliphatic groups only at both terminals of its molecular chain and further having a methyl group serving as an unsubstituted hydrocarbon group free of any unsaturated aliphatic group (viscosity: 5,000 $mm^2/s$, hereinafter referred to as "Vi") was prepared as a component "a".

Next, 271.4 parts by mass of magnesium oxide powder (product name: SL-WR, manufactured by Konoshima Chemical Co., Ltd.) was weighed, and added to the Vi.

Next, 3 parts by mass of sodium=bis{1-[(5-chloro-2-hydroxy-phenyl)azo]-phenylcarbamoyl)-2-naphtholato}iron(III) (product name: S-215S, manufactured by Orient Chemical Industries Co., Ltd., thermal decomposition onset temperature: 312° C.) serving as a charge control agent of a negative charging type with respect to the magnesium oxide powder was weighed, and added to the Vi.

Next, 0.1 part by mass of 1,3,5,7-tetravinyltetramethylcyclotetrasiloxane (product name: SIT7900.0, manufactured by Gelest, Inc.) serving as a curing retarder was added as a component "d" into the mixture of the Vi and the magnesium oxide powder.

Next, 0.03 part by mass of a hydrosilylation catalyst (platinum catalyst, product name: SIP6829.2, manufactured by Gelest, Inc.) was added as a component "c" into the mixture of the Vi, the magnesium oxide powder, and the curing retarder.

Further, 1.2 parts by mass of a silicone polymer having a siloxane backbone and having an active hydrogen group bonded to silicon only in a side chain thereof (viscosity: 30 $mm^2/s$, hereinafter referred to as "SiH") was weighed as a component "b". The silicone polymer was added to the mixture of the Vi, the magnesium oxide powder, the negative charging type charge control agent, the curing retarder, and the platinum catalyst, and the components were sufficiently mixed to provide an addition-curable liquid silicone rubber mixture having blended therein 43 vol % of the magnesium oxide powder.

(2) Formation of Elastic Layer

Next, a fixing belt was produced as described below using the resultant addition-curable liquid silicone rubber mixture containing the magnesium oxide powder and the negative charging type charge control agent.

A nickel electrocast endless sleeve having an inner diameter of 30 mm, a width of 400 mm, and a thickness of 40 μm was prepared as a substrate. In a series of production steps, the endless sleeve was handled while a core was inserted into the sleeve.

First, a primer (product name: DY39-051A/B, manufactured by Dow Corning Toray Co., Ltd.) was applied to the outer peripheral surface of the substrate in a substantially uniform manner. After the solvent had been dried, baking treatment was performed in an electric furnace at a temperature of 160° C. for 30 minutes.

The silicone rubber mixture was applied onto the substrate subjected to the primer treatment by a ring coating method so as to have a thickness of 300 to thereby form a mixture layer.

Next, the corona charger 2 was arranged so that its longitudinal direction was approximately parallel to the axial direction (longitudinal direction) of the substrate 3 having the mixture layer formed thereon (see FIG. 2A and FIG. 2B). Then, while the substrate having the mixture layer formed thereon was rotated at 141 rpm, the surface of the mixture layer was charged with the corona charger.

Charging conditions were set as described below.

Electric current supplied to wire of corona charger: AC 0.7 Hz±150 μA (square wave)

Grid electrode potential: AC 0.7 Hz±900 V (square wave)

Charging time: 160 seconds

Distance between grid electrode and uncured silicone rubber mixture applied onto substrate: 3 mm Next, the substrate having the mixture layer whose surface had been charged was placed in an electric furnace, and was heated at a temperature of 160° C. for 1 minute to primarily cure the mixture layer and then heated at a temperature of 200° C. for 30 minutes to secondarily cure the mixture layer. Thus, an elastic layer was formed. In the resultant elastic layer, the charge control agent was dispersed as particles each having a diameter of 1 μm.

(3) Characteristic Evaluations of Elastic Layer (3-1) Measurement of Hardness and Fracture Energy of Elastic Layer The hardness of the elastic layer was measured with a microrubber hardness meter (MD-1 TYPE-C, manufactured by Kobunshi Keiki Co., Ltd.) in a peak-hold mode. The measurement was performed by bringing a pressing needle of the microrubber hardness meter into contact with the surface of the elastic layer on the opposite side to the substrate side at a total of 40 points, i.e., 8 points in the peripheral direction of the elastic layer by 5 points in the direction perpendicular to the peripheral direction, and the average of measured values was adopted as a value for this evaluation. The measurement of the hardness was performed in an environment having a temperature of 23° C. and a relative humidity of 40%.

In addition, the fracture energy of the elastic layer was measured as described below. A measurement sample was cut out of the elastic layer with a punching die specified in Japanese Industrial Standard (JIS) K 6251-8, and the rubber thickness of the vicinity of its center serving as a measurement site was measured. Next, the measurement sample was tested at room temperature (25° C.) with a tensile tester (product name: STROGRAPH EII-L1, manufactured by Toyo Seiki Seisaku-sho, Ltd.) at a tensile rate of 200 mm/min. The fracture energy was an area obtained as follows: a graph in which the strain of the sample was indicated by an axis of abscissa and a tensile stress was indicated by an axis of ordinate was produced from the measurement results; and measurement data was integrated over the range from a strain of 0% to the strain at which the rubber fractured. As a result, the hardness and the fracture energy of the elastic layer were found to be 74° and 23 $kJ/m^2$, respectively.

(3-2) Heat Capacity per Unit Volume of Elastic Layer

A heat capacity CV per unit volume was calculated from the following equation:

$$CV=Cp\times p$$

where Cp represents a specific heat at constant pressure (J/(kg·K)), and ρ represents a density ($kg/m^3$).

The values of the specific heat at constant pressure and the density in the equation were determined by the following methods.

Specific Heat at Constant Pressure Cp

The specific heat at constant pressure of the elastic layer was measured with a differential scanning calorimeter (product name: DSC823e, manufactured by Mettler-Toledo).

Specifically, pans made of aluminum were used as a pan for a sample and a pan for reference. First, as blank measurement, under a state in which both the pans were empty, measurement was performed by the following program: a temperature in the calorimeter was kept constant at 15° C. for 10 minutes, was then increased to 215° C. at a rate of temperature increase of 10° C./min, and was kept constant at 215° C. for 10 minutes. Next, measurement was performed through use of 10 mg of synthetic sapphire whose specific heat at constant pressure was known as a reference substance by the same program. Next, the same amount of a measurement sample as that of the sapphire for reference, that is, 10 mg thereof was cut out of the elastic layer portion. After that, the sample was set in the sample pan, and measurement was performed by the same program. Those measurement results were analyzed with specific heat analysis software attached to the differential scanning calorimeter, and the specific heat at constant pressure Cp at 25° C. was calculated from the average of the 5 measurement results. As a result, the specific heat at constant pressure of the silicone rubber-containing elastic layer was 1.12 J/(g·K).

Density ρ

The density of the elastic layer was measured with a dry automatic densimeter (product name: ACCUPYC 1330-01, manufactured by Shimadzu Corporation).

Specifically, a sample cell having a volume of 10 $cm^3$ was used, and a sample was cut out of the elastic layer so as to account for about 80% of the volume of the cell. The mass of the sample was measured, and then the sample was loaded into the sample cell.

The sample cell was set in a measuring portion in the apparatus. Helium was used as a gas for measurement, and the cell was purged with the gas. After that, the volume of the sample was measured 10 times. The density of the sample was calculated from the mass of the sample and the measured volume for each measurement, and the average of the calculated values was determined. As a result, the density of the silicone rubber-containing elastic layer was 2.05 $g/cm^3$. The heat capacity CV per unit volume was calculated from the thus determined specific heat at constant pressure Cp and density ρ of the silicone rubber-containing elastic layer, and as a result, was found to be 2.30 $MJ/m^3\cdot K$.

(3-3) Thermal Conductivity of Elastic Layer in its Thickness Direction

The thermal conductivity λ of the elastic layer in its thickness direction was calculated from the following equation:

$$\lambda=\alpha\times Cp\times\rho$$

where λ represents the thermal conductivity of the elastic layer in the thickness direction (W/(m·K)), α represents a thermal diffusivity in the thickness direction ($m^2/s$), Cp represents a specific heat at constant pressure (J/(kg·K)), and ρ represents a density ($kg/m^3$). In this case, for the specific heat at constant pressure Cp and the density ρ of the elastic layer, the units of the values determined by the above-mentioned methods were converted. The value of the thermal diffusivity in the thickness direction was determined by the following method.

Thermal Diffusivity α

The thermal diffusivity of the elastic layer in the thickness direction was measured with a periodical heating method thermal diffusivity measurement system (product name: FTC-1, manufactured by Ulvac-Riko, Inc.) at room temperature (25° C.). A sample piece having an area measuring 8 mm by 12 mm was cut out of the elastic layer with a cutter, and a total of 5 samples were produced. The thickness of each of the samples was measured. Next, the thermal diffusivity of each of the samples was measured a total of 5 times, and the average ($m^2/s$) of the measured values was determined. The thermal conductivity $\lambda$ of the silicone rubber-containing elastic layer was calculated from the specific heat at constant pressure Cp (J/(kg·K)) and the density $\rho$ ($kg/m^3$) of the elastic layer each of which had been subjected to unit conversion, and the measured thermal diffusivity $\alpha$ ($m^2/s$), and as a result, was found to be 1.3 W/(m·K).

(4) Production of Fixing Belt

A substrate having an elastic layer was produced in the same manner as in (1) to (3) above.

Next, while the substrate was rotated so that the surface of the elastic layer had a speed of 20 mm/sec in its peripheral direction, the surface of the elastic layer was irradiated with UV light through use of a UV lamp placed at a distance of 10 mm from the surface of the elastic layer. A low-pressure mercury UV lamp (product name: GLQ500US/11, manufactured by Toshiba Lighting & Technology Corporation (formerly Harison Toshiba Lighting Corporation)) was used as the UV lamp, and the irradiation was performed in an air atmosphere at room temperature (temperature: 25° C.) for 6 minutes.

Next, an addition-curable silicone rubber adhesive (product name: SE1819CV A/B, manufactured by Dow Corning Toray Co., Ltd.) was applied to the UV-irradiated surface of the elastic layer so as to have a thickness of 20 μm. Next, a fluorine resin tube having an inner diameter of 29 mm and a thickness of 30 μm (product name: KURANFLON-LT, manufactured by Kurabo Industries Ltd.) was laminated on the adhesive to produce an endless belt. Next, the endless belt was heated in an electric furnace at a temperature of 200° C. for 1 hour, and thus the adhesive was cured to fix the surface layer formed of the fluorine resin tube onto the elastic layer. Next, both end portions of the endless belt that was the fluorine resin tube fixed onto the elastic layer were cut. Thus, a fixing belt having a width of 341 mm was obtained.

(5) Evaluation of Fixing Belt (5-1) Evaluation of Pressure Resistance Durability of Elastic Layer The fixing belt produced in (4) above was cut open in a direction perpendicular to its peripheral direction to provide one sheet, and four samples each having a size of 50 mm long by 50 mm wide were cut out of the sheet.

Figure 6:
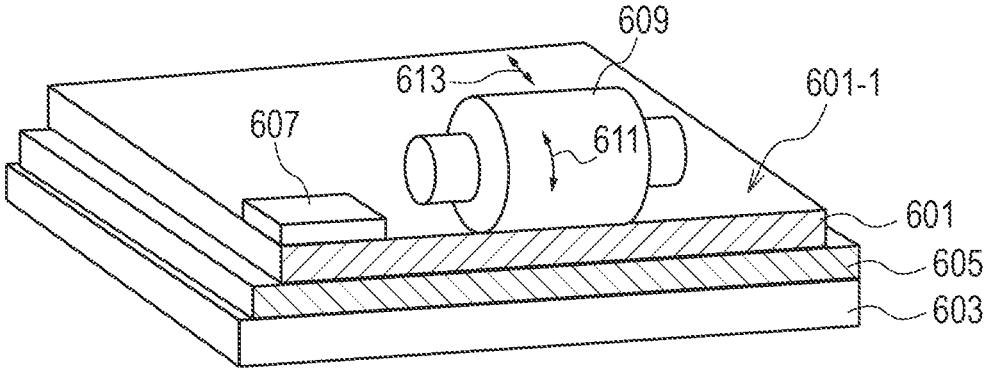
FIG. 6 is a schematic perspective view of a jig for evaluating the pressure resistance durability of the elastic layer according to the present disclosure.

For the samples, pressure resistance durability was evaluated through use of a jig illustrated in FIG. 6. Specifically, a sample 601 was placed on a stainless-steel plate 605 placed on a heater 603 so that its surface layer side was brought into contact with the stainless-steel plate 605. Then, the temperature of a surface 601-1 of the elastic layer of the sample 601 was adjusted to 240° C. with a thermistor 607 placed on the surface 601-1. Then, while a pressing roller (width: 10 mm, diameter: 15 mm) 609 was pressed onto the surface 601-1 at a load of 10N, the pressing roller 609 was rotated in the direction of an arrow 611 to be moved back and forth in the direction of an arrow 613 on the surface 601-1. In this manner, a period of time until visually recognizable breakage occurred in the elastic layer of the sample 601 (hereinafter sometimes referred to as "breaking time") was measured. The average of the breaking times of the four samples was calculated, and adopted as the evaluation result of the pressure resistance durability of the elastic layer of the fixing belt according to this Example.

(5-2) Actual Machine Evaluations (i) A fixing belt produced in the same manner as in (4) above was mounted onto the fixing device of a full-color electrophotographic image forming apparatus (product name: imageRUNNERADVANCE C5051; manufactured by Canon Inc.). The resultant multifunctional peripheral was used to continuously form a cyan solid image on 300,000 sheets of A4 size plain paper. Further, the image on the 10th sheet (hereinafter referred to as "initial image") and the image on the 300,000th sheet (hereinafter referred to as "endurance image") were visually observed, and the presence or absence of gloss unevenness was evaluated by the following criteria.

Rank A: Gloss unevenness due to a fixing failure is not found.

Rank B: Gloss unevenness due to a fixing failure is slightly found.

Rank C: Gloss unevenness due to a fixing failure is clearly found.

(ii) The fixing belt subjected to the image formation on 300,000 sheets in (i) above was removed from the fixing device. The hardness of the surface of the surface layer of the removed fixing belt was measured by bringing a pressing needle of a microrubber hardness meter (MD-1 TYPE-C, manufactured by Kobunshi Keiki Co., Ltd.) into contact therewith. The measurement of the hardness was performed in an environment having a temperature of 23° C. and a relative humidity of 40%. Then, a difference from the hardness of the surface of the surface layer of the fixing belt before being subjected to the image formation on 300,000 sheets, which had been measured in advance by the same method as above, was determined.

Examples 2 and 3

A liquid addition-curable silicone rubber mixture was prepared in the same manner as in Example 1 except that the amount of the charge control agent was changed to 1 part by mass or 5 parts by mass. An elastic layer was formed on a substrate in the same manner as in Example 1 except that this addition-curable liquid silicone rubber mixture was used. The resultant elastic layer was subjected to characteristic evaluations in the same manner as in Example 1. In addition, a fixing belt was produced and evaluated in the same manner as in Example 1 except that the addition-curable liquid silicone rubber mixture prepared above was used. The results of the characteristic evaluations of the elastic layer, and the results of the evaluations as the fixing belt are shown in Table 1.

Example 4

An addition-curable liquid silicone rubber mixture was prepared in the same manner as in Example 1 except that aluminum 3,5-di-tert-butylsalicylate (product name: E-101, manufactured by Orient Chemical Industries Co., Ltd., thermal decomposition onset temperature: 203° C.) was used as the charge control agent. An elastic layer was formed on a substrate in the same manner as in Example 1 except that this addition-curable liquid silicone rubber mixture was used. The resultant elastic layer was subjected to characteristic evaluations in the same manner as in Example 1. In addition, a fixing belt was produced and evaluated in the same manner as in Example 1 except that the addition-curable liquid silicone rubber mixture prepared above was used. The results of the characteristic evaluations of the elastic layer, and the results of the evaluations as the fixing belt are shown in Table 1.

Example 5

An addition-curable liquid silicone rubber mixture was obtained in the same manner as in Example 1 except that: a silicone polymer having vinyl groups serving as unsaturated aliphatic groups at both ends of its molecular chain and side chain and further having a methyl group serving as an unsubstituted hydrocarbon group free of any unsaturated aliphatic group (viscosity: 20,000 $mm^2/s$, hereinafter referred to as "Vi-2") was used as the component "a"; and 162.2 parts by mass of metal silicon powder (product name: #600WB, manufactured by Kinsei Matec Co., Ltd.) was used as the heat conductive filler. The volume ratio of the metal silicon powder in the resultant addition-curable liquid silicone rubber mixture was 40 vol %.

An elastic layer was formed on a substrate in the same manner as in Example 1 except that this addition-curable liquid silicone rubber mixture was used. The resultant elastic layer was subjected to characteristic evaluations in the same manner as in Example 1. In addition, a fixing belt was produced and evaluated in the same manner as in Example 1 except that the addition-curable liquid silicone rubber mixture prepared above was used. The results of the characteristic evaluations of the elastic layer, and the results of the evaluations as the fixing belt are shown in Table 1.

Example 6

An addition-curable liquid silicone rubber mixture was obtained in the same manner as in Example 5 except that iron bis[1-(5-chloro-2-hydroxyphenylazo)-2-naphtholato] chromate(III) (product name: S-34, manufactured by Orient Chemical Industries Co., Ltd., thermal decomposition onset temperature: 325° C.) was used as the charge control agent. An elastic layer was formed on a substrate in the same manner as in Example 1 except that this addition-curable liquid silicone rubber mixture was used. The resultant elastic layer was subjected to characteristic evaluations in the same manner as in Example 1. In addition, a fixing belt was produced and evaluated in the same manner as in Example 1 except that the addition-curable liquid silicone rubber mixture prepared above was used. The results of the characteristic evaluations of the elastic layer, and the results of the evaluations as the fixing belt are shown in Table 1.

Example 7

An addition-curable liquid silicone rubber mixture containing zinc oxide powder at a volume ratio of 35% was obtained in the same manner as in Example 1 except that 317 parts by mass of zinc oxide powder was used as the heat conductive filler. An elastic layer was formed on a substrate in the same manner as in Example 1 except that: this addition-curable liquid silicone rubber mixture was used; and the charging treatment of the surface of the addition-curable liquid silicone rubber mixture layer was not performed. The resultant elastic layer was subjected to characteristic evaluations in the same manner as in Example 1. In addition, a fixing belt was produced and evaluated in the same manner as in Example 1 except that: the addition-curable liquid silicone rubber mixture prepared above was used; and the charging treatment of the surface of the addition-curable liquid silicone rubber mixture layer was not performed. The results of the characteristic evaluations of the elastic layer, and the results of the evaluations as the fixing belt are shown in Table 1.

Example 8

An addition-curable liquid silicone rubber mixture containing alumina powder at a volume ratio of 46% was obtained in the same manner as in Example 5 except that 350 parts by mass of alumina powder was used as the heat conductive filler. An elastic layer was formed on a substrate in the same manner as in Example 7 except that this addition-curable liquid silicone rubber mixture was used. The resultant elastic layer was subjected to characteristic evaluations in the same manner as in Example 1. In addition, a fixing belt was produced and evaluated in the same manner as in Example 7 except that the addition-curable liquid silicone rubber mixture prepared above was used. The results of the characteristic evaluations of the elastic layer, and the results of the evaluations as the fixing belt are shown in Table 1.

Example 9

An elastic layer was formed on a substrate in the same manner as in Example 1 except that the charging treatment of the surface of the addition-curable liquid silicone rubber mixture layer was not performed. The resultant elastic layer was subjected to characteristic evaluations in the same manner as in Example 1.

In addition, a fixing belt was produced and evaluated in the same manner as in Example 1 except that the charging treatment of the surface of the addition-curable liquid silicone rubber mixture layer was not performed. The results of the characteristic evaluations of the elastic layer, and the results of the evaluations as the fixing belt are shown in Table 1.

Example 10

An elastic layer was formed on a substrate in the same manner as in Example 5 except that the charging treatment of the surface of the addition-curable liquid silicone rubber mixture layer was not performed. The resultant elastic layer was subjected to characteristic evaluations in the same manner as in Example 1.

In addition, a fixing belt was produced and evaluated in the same manner as in Example 5 except that the charging treatment of the surface of the addition-curable liquid silicone rubber mixture layer was not performed.

The results of the characteristic evaluations of the elastic layer, and the results of the evaluations as the fixing belt are shown in Table 1.

Comparative Example 1

An addition-curable liquid silicone rubber mixture containing magnesium oxide powder at a ratio of 43 vol % was obtained in the same manner as in Example 1 except that no charge control agent was used. An elastic layer was formed on a substrate in the same manner as in Example 1 except that this addition-curable liquid silicone rubber mixture was used. The resultant elastic layer was subjected to characteristic evaluations in the same manner as in Example 1. In addition, a fixing belt was produced and evaluated in the same manner as in Example 1 except that the addition-curable liquid silicone rubber mixture prepared above was used. The results of the characteristic evaluations of the elastic layer, and the results of the evaluations as the fixing belt are shown in Table 1.

Comparative Example 2

An addition-curable liquid silicone rubber mixture containing metal silicon powder at a ratio of 40 vol % was obtained in the same manner as in Example 5 except that no charge control agent was used. An elastic layer was formed on a substrate in the same manner as in Example 5 except that this addition-curable liquid silicone rubber mixture was used. The resultant elastic layer was subjected to characteristic evaluations in the same manner as in Example 1. In addition, a fixing belt was produced and evaluated in the same manner as in Example 5 except that the addition-curable liquid silicone rubber mixture prepared above was used. The results of the characteristic evaluations of the elastic layer, and the results of the evaluations as the fixing belt are shown in Table 1.

Comparative Example 3

An addition-curable liquid silicone rubber mixture containing zinc oxide powder at a ratio of 35 vol % was obtained in the same manner as in Example 7 except that no charge control agent was used. An elastic layer was formed on a substrate in the same manner as in Example 7 except that this addition-curable liquid silicone rubber mixture was used. The resultant elastic layer was subjected to characteristic evaluations in the same manner as in Example 7. In addition, a fixing belt was produced and evaluated in the same manner as in Example 7 except that the addition-curable liquid silicone rubber mixture prepared above was used. The results of the characteristic evaluations of the elastic layer, and the results of the evaluations as the fixing belt are shown in Table 1.

Comparative Example 4

An addition-curable liquid silicone rubber mixture containing alumina powder at a ratio of 46 vol % was obtained in the same manner as in Example 8 except that no charge control agent was used. An elastic layer was formed on a substrate in the same manner as in Example 8 except that this addition-curable liquid silicone rubber mixture was used. The resultant elastic layer was subjected to characteristic evaluations in the same manner as in Example 8. In addition, a fixing belt was produced and evaluated in the same manner as in Example 8 except that the addition-curable liquid silicone rubber mixture prepared above was used. The results of the characteristic evaluations of the elastic layer, and the results of the evaluations as the fixing belt are shown in Table 1.

TABLE 1

| | | Heat conductive filler | | Negative charging type charge control agent | | | |
|---|---|---|---|---|---|---|---|
| | | Kind | Content (volume ratio %) | Kind | Thermal decomposition onset temperature (° C.) | Blending amount (part(s) by mass) | Elastic layer Charging step |
| Example | 1 | Magnesium oxide | 43 | Azo iron complex (S-215S) | 312 | 3 | Present |
| | 2 | Magnesium oxide | 43 | Azo iron complex (S-215S) | 312 | 1 | Present |
| | 3 | Magnesium oxide | 43 | Azo iron complex (S-215S) | 312 | 5 | Present |
| | 4 | Magnesium oxide | 43 | Salicylic acid-aluminum complex (E-101) | 203 | 3 | Present |
| | 5 | Metal silicon | 40 | Azo iron complex (S-215S) | 312 | 3 | Present |
| | 6 | Metal silicon | 40 | Azo chromium complex (S-34) | 325 | 3 | Present |
| | 7 | Zinc oxide | 35 | Azo iron complex (S-215S) | 312 | 3 | Absent |
| | 8 | Alumina | 46 | Azo iron complex (S-215S) | 312 | 3 | Absent |
| | 9 | Magnesium oxide | 43 | Azo iron complex (S-215S) | 312 | 3 | Absent |
| | 10 | Metal silicon | 40 | Azo iron complex (S-215S) | 312 | 3 | Absent |
| Comparative Example | 1 | Magnesium oxide | 43 | — | — | — | Present |
| | 2 | Metal silicon | 40 | — | — | — | Present |
| | 3 | Zinc oxide | 35 | — | — | — | Absent |
| | 4 | Alumina | 46 | — | — | — | Absent |

TABLE 1-continued

| | | Elastic layer | | | Fixing belt | | | |
|---|---|---|---|---|---|---|---|---|
| | | Thermal conductivity (W/mK) | Hardness (°) | Fracture energy (kJ/m$^2$) | Pressure resistance durability (hours) | Image quality evaluation Initial | Image quality evaluation After 300,000 sheets | Change in hardness of elastic layer |
| Example | 1 | 1.3 | 74 | 23 | 190 | A | A | Less than 1° |
| | 2 | 1.3 | 77 | 20 | 160 | A | A | Less than 1° |
| | 3 | 1.3 | 74 | 23 | 190 | A | A | Less than 1° |
| | 4 | 1.3 | 73 | 25 | 200 | A | B | Increased by 5° |
| | 5 | 1.1 | 75 | 31 | 110 | A | A | Less than 1° |
| | 6 | 1.1 | 79 | 31 | 110 | A | A | Increased by 1° |
| | 7 | 0.7 | 72 | 30 | 100 | A | A | Less than 1° |
| | 8 | 1.0 | 74 | 55 | 80 | A | A | Less than 1° |
| | 9 | 1.0 | 75 | 20 | 160 | A | A | Less than 1° |
| | 10 | 0.7 | 72 | 29 | 100 | A | A | Less than 1° |
| Comparative Example | 1 | 1.3 | 79 | 15 | 130 | — | — | — |
| | 2 | 1.1 | 82 | 28 | 90 | — | — | — |
| | 3 | 0.7 | 73 | 25 | 80 | — | — | — |
| | 4 | 1.0 | 74 | 50 | 70 | — | — | — |

[Evaluation Results]

The evaluation results of Examples and Comparative Examples shown in Table 1 above are described.

By virtue of containing the negatively chargeable charge control agent, the elastic layers according to Examples 1 to 10 had large fracture energies and were improved in pressure resistance durability as compared to the elastic layers according to Comparative Examples. In addition, none of the fixing belts according to Examples 1 to 10 was found to have undergone breakage of the elastic layer in the non-paper passing portion of the fixing belt, which is particularly liable to fracture by contact with an end portion of paper, even after the image formation on 300,000 sheets.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-150561, filed Sep. 8, 2020, and Japanese Patent Application No. 2021-125683, filed Jul. 30, 2021, which are hereby incorporated by reference herein in their entirety.

What is claimed is:

1. An electrophotographic fixing member comprising:

a substrate;

an elastic layer on the substrate; and a surface layer, in this order, wherein the elastic layer contains a silicone rubber and a heat conductive filler dispersed in the silicone rubber, wherein the heat conductive filler is selected from the group consisting of metal oxide particles and metal particles each having a surface at least part of which is formed of a metal oxide, and wherein the elastic layer further contains a charge control agent negatively chargeable with respect to the heat conductive filler.

2. The electrophotographic fixing member for electrophotography according to claim 1, wherein the heat conductive filler is at least one selected from the group consisting of: magnesium oxide; metal silicon; alumina; and zinc oxide.

3. The electrophotographic fixing member for electrophotography according to claim 1, wherein the charge control agent has a thermal decomposition onset temperature of 300° C. or more.

4. The electrophotographic fixing member for electrophotography according to claim 1, wherein the charge control agent is an azo metal complex.

5. The electrophotographic fixing member for electrophotography according to claim 4, wherein the azo metal complex is a compound represented by one of structural formulae (i) and (ii):

(i)

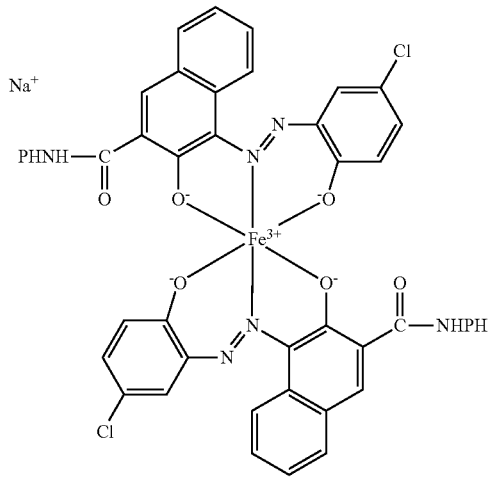

-continued (ii)

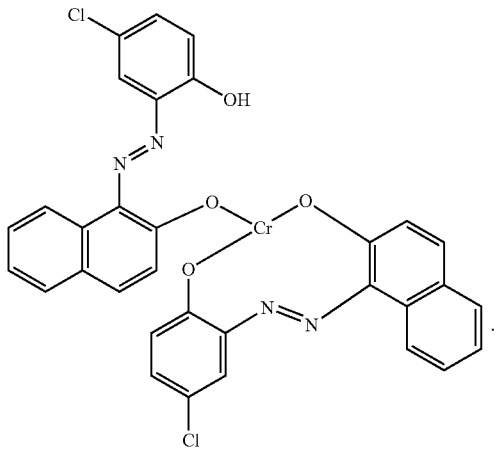

6. The electrophotographic fixing member for electrophotography according to claim 1, wherein a blending amount of the charge control agent is 1 to 5 parts by mass with respect to 100 parts by mass of the silicone rubber.

7. The electrophotographic fixing member for electrophotography according to claim 1, wherein the charge control agent is dispersed in the silicone rubber as particles each having a diameter of 1 μm or less.

8. A fixing device comprising:

a heating member; and a pressurizing member arranged to face the heating member, wherein at least one of the heating member and the pressurizing member is an electrophotographic fixing member including a substrate, an elastic layer on the substrate, and a surface layer in the stated order, wherein the elastic layer contains a silicone rubber and a heat conductive filler dispersed in the silicone rubber, wherein the heat conductive filler is selected from the group consisting of metal oxide particles and metal particles each having a surface at least part of which is formed of a metal oxide, and wherein the elastic layer further contains a charge control agent negatively chargeable with respect to the heat conductive filler.

9. An electrophotographic image forming apparatus comprising a fixing device, the fixing device including:

a heating member; and a pressurizing member arranged to face the heating member, wherein at least one of the heating member and the pressurizing member is an electrophotographic fixing member including a substrate, an elastic layer on the substrate, and a surface layer in the stated order, wherein the elastic layer contains a silicone rubber and a heat conductive filler dispersed in the silicone rubber, wherein the heat conductive filler is selected from the group consisting of metal oxide particles and metal particles each having a surface at least part of which is formed of a metal oxide, and wherein the elastic layer further contains a charge control agent negatively chargeable with respect to the heat conductive filler.

* * * * *